United States Patent [19]

Thomas

[11] 3,964,233

[45] June 22, 1976

[54] EGG PACKING METHOD AND APPARATUS

[75] Inventor: Leslie P. Thomas, Plymouth, Mich.

[73] Assignee: Diamond International Corporation, New York, N.Y.

[22] Filed: May 15, 1974

[21] Appl. No.: 470,314

[52] U.S. Cl. ..... 53/26; 53/152; 53/160; 53/246; 53/247; 198/282; 198/32

[51] Int. Cl.[2] ..... B65B 21/06; B65B 35/54

[58] Field of Search ..... 53/62, 26, 152, 166, 53/247, 246, 248, 35, 160; 198/270, 269, 271, 282, 264, 266, 257, 33

[56] References Cited

UNITED STATES PATENTS

| | | | |
|---|---|---|---|
| 2,895,274 | 7/1959 | Mumma | 53/248 X |
| 3,342,012 | 9/1967 | Reading | 53/62 |
| 3,592,001 | 7/1971 | Gross | 53/62 X |
| 3,592,327 | 7/1971 | Koch et al. | 198/282 X |
| 3,722,173 | 3/1973 | Noguchi | 53/62 |
| 3,820,301 | 6/1974 | Willsey | 53/62 |

*Primary Examiner*—Leon Gilden
*Attorney, Agent, or Firm*—Karl W. Flocks

[57] ABSTRACT

An egg packer with the eggs picked up from a slotted conveyor by a conveyor of rollers having pockets formed between each of the rollers and an adjacent parallel rod, carried up an incline while being rolled and travelling toward its small end, and contacting a guide tongue as it goes over the top of the roller conveyor which guide retards the large end of the egg causing it to pass point down into a retainer for transfer to a clam-shell transfer means which shuttles the egg between the retainer and a receiving pocket therebelow, while adjusting the horizontal spacing between eggs during their descent to the receiving pockets.

39 Claims, 8 Drawing Figures

EGG PACKING METHOD AND APPARATUS

BACKGROUND OF THE INVENTION

The present invention relates to a machine for handling articles such as eggs and more particularly to the grouping and orienting of these articles in the pockets of a transport means such as a carton or tray.

Prior art devices have had difficulites in maintaining a smooth high-spaced operation. The pressure of a large supply of articles fed into those machines has caused breakage from stresses due to jamming of eggs into following eggs and lack of control of entry of eggs into receiving pockets.

For example, passing of eggs or similar articles from rollers directly into receiving pockets may be workable at lower packing speeds but in the high speed operation of the present invention where cycle time of 0.7 to 1.0 second may be desired, the lack of control of the exact moment the egg falls free from the roller conveyor and lack of full control of entry into the receiving pockets would present problems.

For grouping eggs for packing it is necessary to restrain the filled channels until every channel has an egg at its discharge point. The common prior art practice is to use a gate mechanism or paddle wheel escapement for this purpose. As a result, an edge of some sort must be forced between the egg being passed and the succeeding egg which must be restrained until the next index cycle. The present invention has eliminated the use of any gate escapement mechanism while attempting to avoid double feeds.

The present invention has attempted to solve the problems of the prior art by components which are effective under high-speed conditions.

SUMMARY OF THE INVENTION

The present invention is a simple, high-speed egg packaging machine that will receive a random supply of eggs, group them into rows, orient each egg and place them point downward in pockets of a transport means.

To take advantage of a high capacity reservoir without excessive stress on the eggs at the reservoir discharge point and to avoid double feeds, an inclined roller conveyor is used to pick up and further convey the eggs from that discharge point.

The use of a turning roller and a non-turning support to orient eggs is commonly used, however, their arrangement in an inclined conveyor as in the present invention allows the close egg spacing needed to remove controlled groups of eggs from the channels at the reservoir discharge point without picking up doubles even when egg size is small. The use of an incline results in greater weight on the driving roller and less on the stationary member, which aids the turning of the egg for the desired movement toward its small end.

A guide tongue located at the upper end of the inclined conveyor allows proper turning of the egg at that point while avoiding interference with a closely following egg.

Fast, accurate, and controlled placement of the eggs in receiving pockets in point-down position is completed by the transfer means of the present invention between the inclined conveyor and the receiving pockets.

The present invention combines an inclined roller, conveyor, guide tongue adjacent the top of said conveyor, and retainer and clam-shell transfer means to shuttle eggs to receiving pockets of a transport means.

In addition the present invention adjusts the spacing between the laterally aligned eggs to that of the receiving pockets during their vertical descent in the clam-shell transfer means.

BRIEF DESCRIPTION OF THE DRAWINGS

Other objects and advantages which are inherent in the invention will become apparent from the following description, reference being had to the accompanying drawings wherein.

DESCRIPTION OF THE PREFERRED EMBODIMENT

Figure 1:
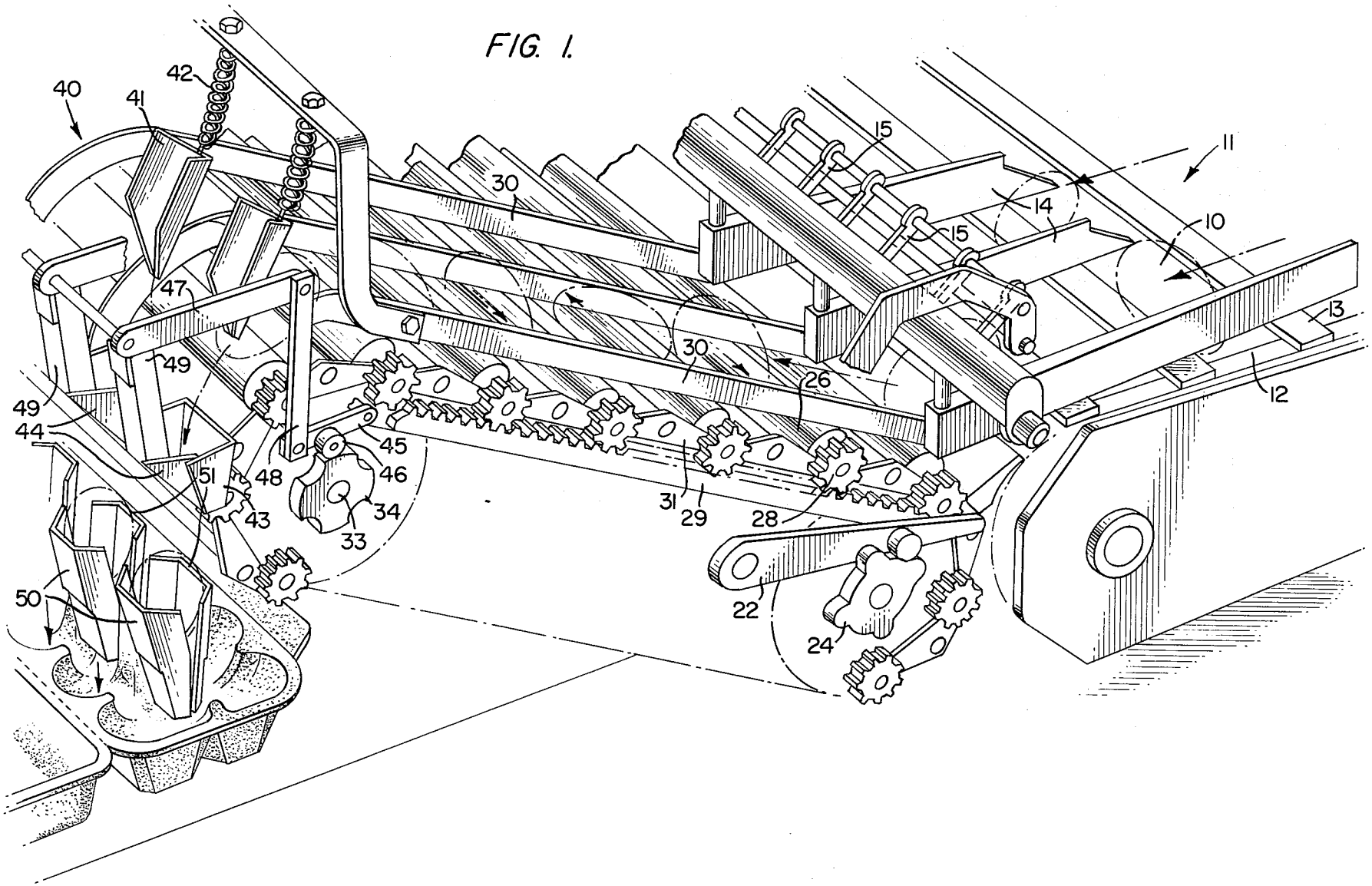
FIG. 1 is a partial perspective view of a preferred embodiment of the over-all machine.
Figure 2:
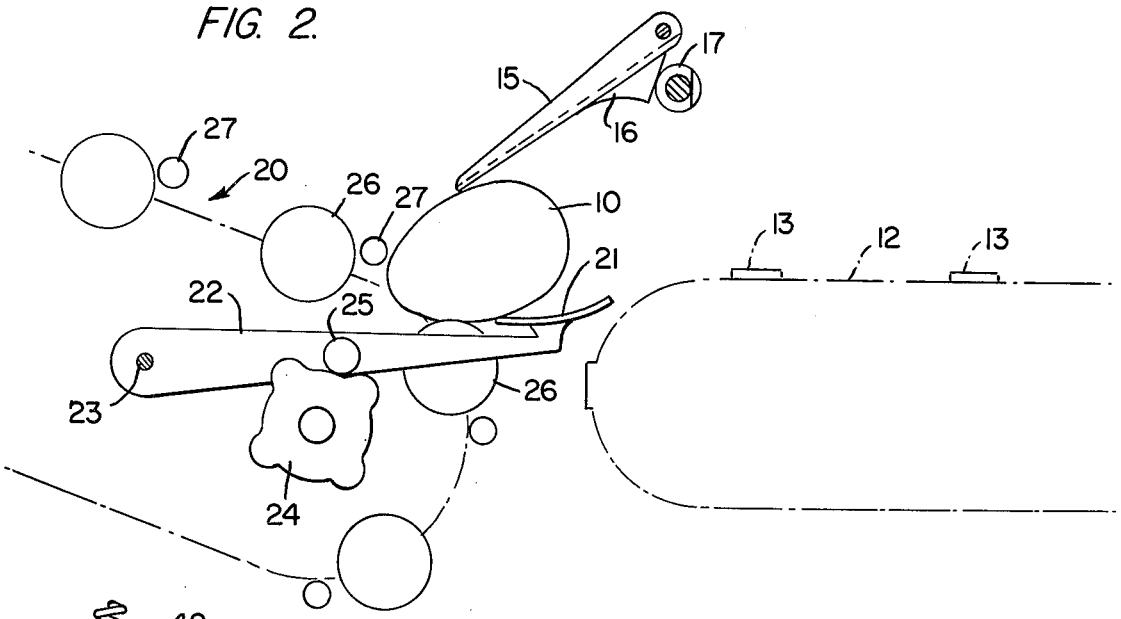
FIG. 2 is a diagrammatic elevational view of feed between the reservoir and inclined roller conveyor.

Referring to the over-all view of FIG. 1 and to the remaining FIGS. 2–8 , in order, the passage of the eggs from reservoir to the receiving pockets of cartons is shown.

The eggs 10 or similar type articles are moved forward in reservoir 11 which in the embodiment shown is a conveyor 12 having moving slots 13. A moving divider 14 possibly of a plastic substance spaced with a constant 2½ inches between each divider channels the eggs in reservoir 11 into single file positions. The eggs are then moved past an interrogation system having plastic fingers 15 which are designed to interfere with the path of eggs of any size so that an egg may not pass without moving a plastic finger 15. Each plastic finger 15 has a built-in flag 16 which interrupts a light beam between phototube light and cell 17 as shown in the detail drawing of FIG. 2. The purpose of fingers 15 is for indexing to make certain that eggs are at the interrogation station. Indexing here does not mean continuous intermittent motion on this machine. The function is simple as long as the supply of eggs is greater or equal to the capacity of the machine. It will run continuously. But as soon as the rate falls below the output, it must wait for eggs and there is then an indexing motion.

As the egg 10 leaves conveyor 12, it moves onto egg transfer pad 21 for transfer to inclined roller conveyor 20. Egg transfer pad 21 is mounted on the opposite end of arm 22 from its pivot point 23. Cam 24 connected for movement with inclined roller conveyor 20 rotates and moves arm 22 through movement of cam follower 25 attached to arm 22 so as to lift each egg 10 in timed relationship onto inclined roller conveyor 20 between a roller 26 and a stationary rod 27 located in a position forward in the direction of movement of roller 26.

Inclined roller conveyor 20 consists of stationary rods 27 and gear driven rollers 26.

Figure 3:
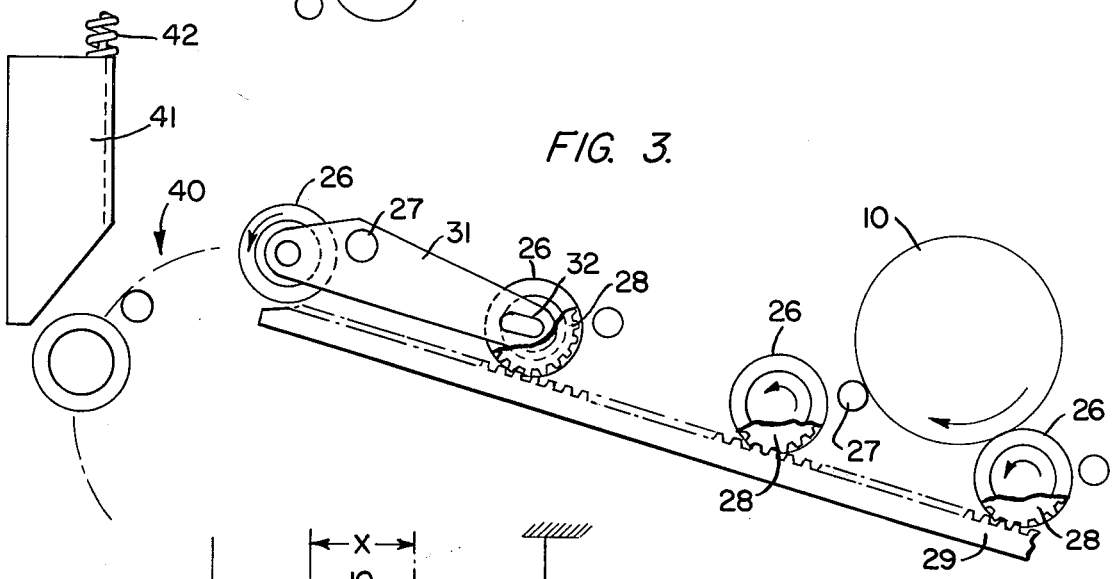
FIG. 3 is a diagrammatic elevational view of the upper portion of the inclined roller conveyor and a portion of the roller operating mechanism.

As the egg starts up the inclined roller conveyor 20, the roller 26 rotates by means of a pinion gear 28 fastened to one end which engages with a rack gear 29 which is stationary (see FIG. 3). Rollers 26 being carried up the incline as part of inclined roller conveyor 20 are forced to turn. The egg is then conveyed by stationary rod 27 and rotating roller 26 up the inclined conveyor 20; rotating roller 26 driving the egg in a clockwise direction. Because of the incline, the center of gravity of the egg is shifted toward drive roller 26 giving added driving force for end alignment. The end alignment is, of course, accomplished by the egg being cone shaped. This causes the egg to travel in a lateral direction with the small end always leading (see FIG. 4). The egg then travels in this direction until it meets egg channel side plates 30 which are parallel plates with a distance between them large enough to offset the center of gravity of a jumbo egg, as for example, by ¼ inch in respect to half of the distance between these plates. Once the egg reaches either of the side plates 30 of that channel, it continues there on up the inclined conveyor 20.

As also shown in FIG. 3, the rollers 26 are connected to each other through carrier links 31 connecting each roller 26 to the following roller 26. Stationary rod 27 which in the preferred embodiment is not rotatable but which could be free to do so in other embodiments, is mounted on and carried by carrier link 31. Carrier link 31 in its connection to a following roller 26 has a slot 32 through which the center of rotation of pinion gear 28 passes and which is used to take up cordal change at the sprockets of conveyor 20.

At the top of inclined roller conveyor 20 just as a roller 26 enters the radius of the sprocket of conveyor 20 at that end, for a 180° return, the egg starts moving at a higher velocity. This increase in speed is very beneficial in helping the egg through this area 40 where it encounters a guide tongue or plow 41 on its downward path to a pocket of an egg carton or tray.

To explain this change in velocity, consider two pulleys spread apart some nominal distance, and then a rubber band attached over both pulleys. Attach a piece of tape or other marker at a point on the rubber band. Now at any given rpm of the pulleys, the center or pitch line of the rubber band remains at one constant velocity. But the piece of tape or marker will only stay at that same velocity between the tangent points of the pulleys. As soon as it enters the sprocket radius, it increases velocity by a factor of the plus distance out from the pitch line of the rubber band, as would any object fastened to or placed on the rubber band.

Pinion gear 28 in area 40 then disengages from rack gear 29 allowing the roller 26 to turn freely. The egg is free to pivot around guide tongue or plow 41. This pivoting causes a rotating force on roller 26 but due to the freely turning roller there is no restriction of egg movement. At this time also, stationary rod 27 has retracted in toward the sprocket center due to cordal action, which helps to discharge the egg. Plows 41 are centrally located in relation to pairs of channel side plates 30 at the 180° return area and so positioned that it takes maximum advantage of egg separation from conveyor 20 through the first 90° arc. This geometry is one of the reasons for an inclined roller conveyor portion of the machine.

Other reasons for this inclined portion are to prevent reservoir egg pressure from developing doubling of eggs or egg catapulating; to obtain added egg end alignment driving force due to the center of gravity shift moving weight onto the rotating roller; and to form a deeper pocket at the egg entry end.

The plow or guide tongue 41 shown (FIGs. 1, 3, 4 and 5) is V-shaped in plan view and supported by extension spring 42. Spring 42 allows plow 41 to move in any direction but always to return to a center position. Plow 41 itself can be made, for example, of 0.005 inch thick stainless steel stock which allows the plow to bend freely and still retain its shape.

When the egg leaves the area of plow or guide tongue 41, it drops point down into plastic retainer 43 and is held in retainer 43 by a swinging plastic clam-shell 44 which forms a cup-shaped holder with retainer 43. The egg temporarily comes to rest between retainer 43 and shell 44. Retainer 43 is fastened permanently in position such as by fastening to channel side plates 30. Swinging plastic clam-shell 44 is mechanically connected to the drive shaft 33 of inclined roller conveyor 20 (FIGS. 1, 5, 6 and 7). As drive shaft 33 rotates, cam 34 mounted for rotation therewith raises and lowers pivoting link 45 through contact with cam follower 46 thereby pivoting member 47 through connecting arm 48 along with arm 49 attached for movement with member 47. Movement of arm 49 moves swinging plastic clam-shell toward, or after receipt of an egg, away from retainer 43, thereby dropping the egg into a pair of moving clam-shells 50,51 therebelow. The station of retainer 43 and clam-shell 44 is a secondary drop station. Its primary function is to remove the drop time difference between egg sizes and shapes to allow uniform drop into the pairs of moving clam-shells 50,51 and thus allow speed-up of delivery time.

Figure 8:
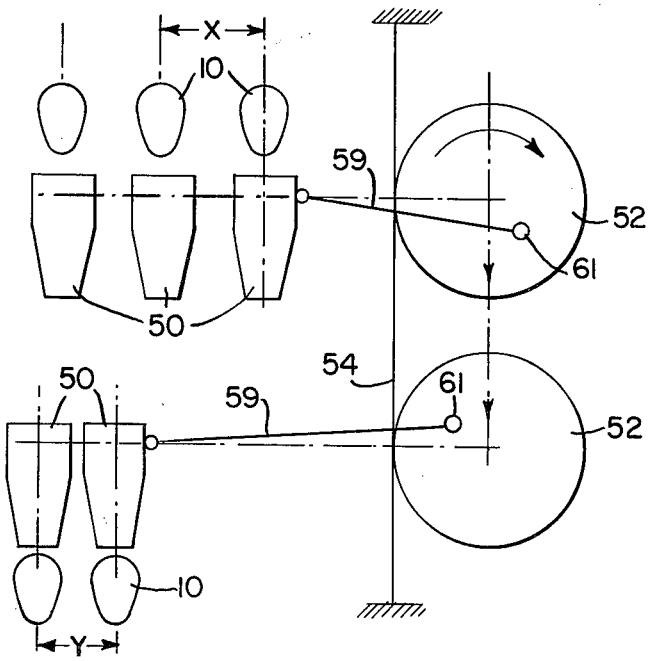
FIG. 8 is an explanatory diagram regarding the transfer mechanism of FIG. 7.
Figure 4:
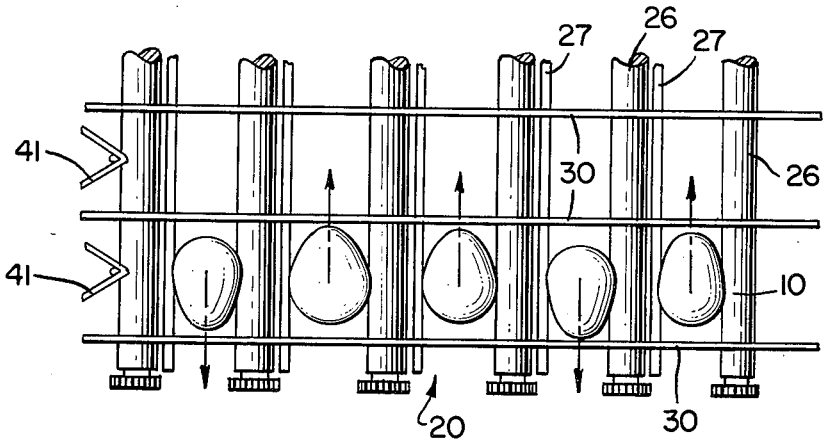
FIG. 4 is a diagrammatic top plan view of a portion of the inclined roller conveyor of FIG. 3.
Figure 5:
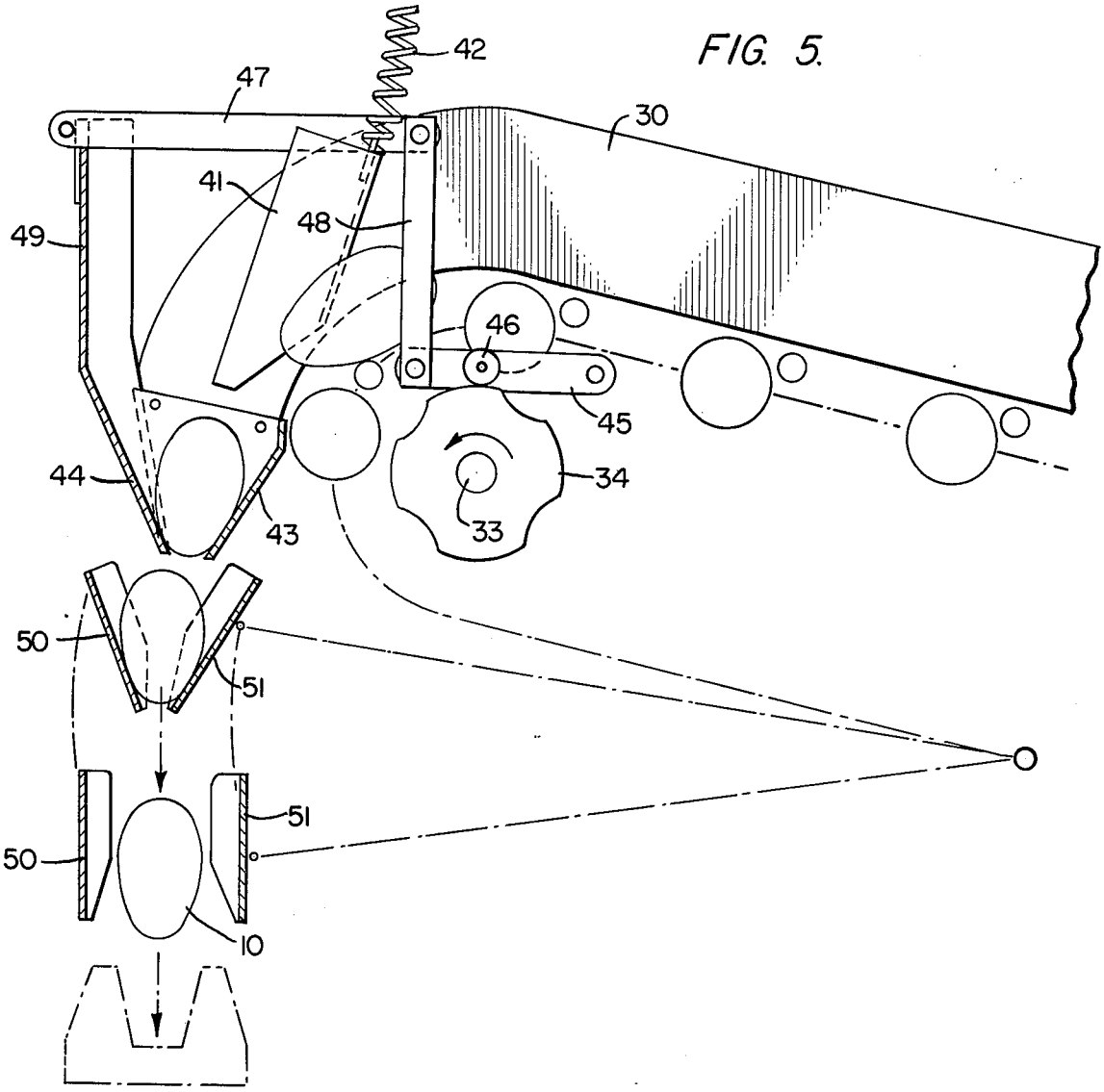
FIG. 5 is a diagrammatic elevational view of the transfer mechanism between the inclined roller conveyor and the receiving pockets.

Moving clam-shells 50,51 receiving the egg are drawlink connected with all of shells 50 so connected to each other, and all shells 51 so connected to each other. The reason for this drawlink connection is shown in FIG. 8 wherein the shells 50 and 51, but in this figure, shells 50, are shown spread out from each other near their top position so as to receive the eggs from the inclined conveyor with a center-to-center spacing X. As these shells with the eggs therein descend toward the egg carton or tray pockets therebelow, the shells are moved toward each other to accommodate the eggs to a center-to-center spacing Y to match the spacing laterally between the tray or carton pockets.

Figure 7:
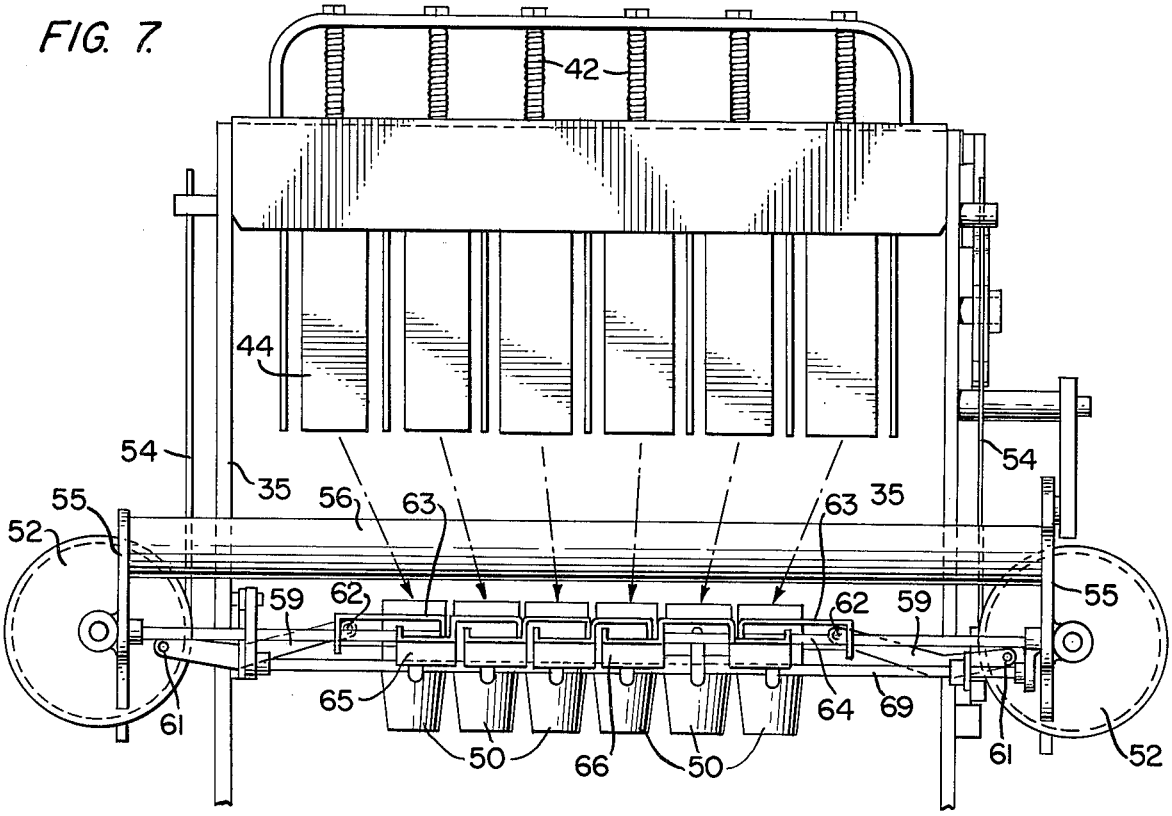
FIG. 7 is a back end view of portion of the apparatus shown in FIG. 6.

This horizontal or lateral movement of shells is controlled by rotating plastic wheels 52 each having a groove 53 around which is wound a steel cable 54 extended vertically on opposite sides of the frame 35 of the inclined roller conveyor 20. The wheels 52 are each mounted on supporting frames 55 which frames are connected to each other by their connection on the ends of cross members 56. Frames 55 are moved vertically alongside steel cables 54 by the connection of at least one of frames 55 to a pair of pivoted parallel action arms 57 and 58 with arm 58 geared to movement of said inclined roller conveyor 20 and pivotally connected to frame 35. The vertical movement of supporting frames 55 causes the rotation of wheels 52 along the steel cable 54. An eccentrically attached crank arm 59 is connected to each wheel 52 at pivotal point 61 which point 61 is at the outermost point from the apparatus at the top position of the shells 50,51 and its innermost point to the apparatus at the point of shells 50,51 separation to release the eggs into the carton or tray pockets. As shown in more detail in FIG. 7, with the wheels 52 at about the lowest point, wheels 52 are rotatably mounted on supporting frames 55, and crank arms 59 which are each pivotally attached to a wheel 52 at point 61 are pivotally attached at their opposite ends to a cross bar connected at point 62 which in turn is connected to an end link 63 having a U-shape with the ends of the U slidably mounted on rods 64 extending between supporting frames 55. Only one side of the moving clam-shell assembly, namely clam-shells 50, are shown in FIG. 7 but the side with clam-shells 51 also have U-shaped end links similar to end links 63 shown and other links similar to those shown, so as to act in a similar manner in accordance with the movement of wheels 52 and crank arms 59 attached to the wheels 52 and end links.

Each successive link 65 or 66 is attached to one of the clam-shells 50 and either has three holes to slidably mount it on rod 64 as in the case of links 65 or four holes for slidable mounting on rod 64 as in the case of link 66. The shapes as shown in FIG. 7 allow lost motion connection between the links and upon upward movement of the clam-shells they will move so as to increase the spacing therebetween to the X spacing since rotation of wheels 52 will move crank arms 59 outward pulling along end links 63, which after some lost motion will move adjacent links outward which in turn after further lost motion will move other adjacent links outward and thus move clam-shells 50, and clam-shells 51 similarly, outward. During lowering of the clam-shell assembly the action is reversed with inward movement of crank arms 59 moving end links 63 inward and after lost motion causing the sides to push against adjacent links thereby moving links and clam-shells closer together again as in FIG. 7, the clam-shell motion thus being a cycloidal motion.

Figure 6:
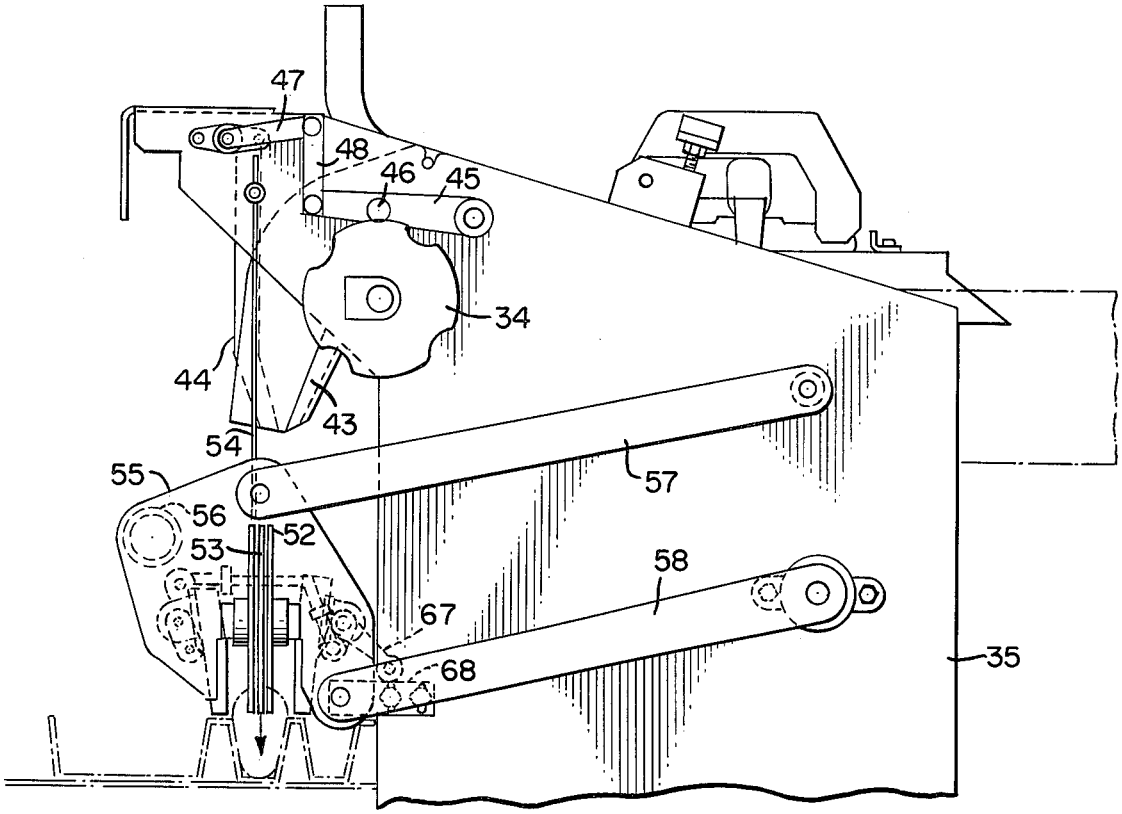
FIG. 6 is a side elevational view of the sidewall of the inclined roller conveyor and attachment of the transfer mechanism of FIG. 5.

At the same time as the clam-shells 50,51 move together and approach the bottom of their descent an arm 67 shown in dashed outine in FIG. 6 encounters projection piece 68. The raising of the end of arm 67 by piece 68 attached to frame 35 operates through linkage also shown in dashed outline in FIG. 6 and in prior art so as to move rods 69 connected to shells 50 and a similarly placed rod connected to shells 51 so as to spread each pair of shells 50,51 and drop the egg held therebetween into the pocket below.

It will be obvious to those skilled in the art that various changes may be made without departing from the scope of the invention and the invention is not to be considered limited to what is shown in the drawings and described in the specification.

What is claimed is:

1. A method of packing articles such as eggs in the pockets of a carton or tray comprising the steps of
- separating the eggs into rows,
- feeding the eggs in each row one at a time to an inclined conveyor,
- moving the eggs in the direction of their pointed ends while also moving them up the inclined conveyor,
- turning the eggs to a point down position near the top of the inclined conveyor, by contacting each egg and turning it toward the point down position on the inclined conveyor upper end,
- and supportingly carrying the eggs after they assume and while maintained in the point down position to the pockets therebelow.

2. The method of claim 1, further characterized by
- moving the eggs in the direction of their pointed ends by rotating the eggs while on the inclined conveyor.

3. The method of claim 1, further characterized by
- turning the eggs toward a point down position by moving them past while contacting a member centered between the limits of travel of the eggs moving in the direction of their pointed ends.

4. The method of claim 1, further characterized by
- temporarily arresting the downward movement of the eggs before carrying the eggs to the pockets from the top of the inclined conveyor.

5. The method of claim 4, further characterized by
- moving separate rows of the eggs in a horizontal direction to change their center-to-center spacing while carrying them down to the pockets.

6. The method of claim 1, further characterized by
- moving separate rows of the eggs in a horizontal direction to change their center-to-center spacing while carrying them down to the pockets.

7. The method of claim 6, further characterized by
- changing the center-to-center spacing to make it smaller thus moving the eggs closer together to place them into the pockets.

8. Apparatus for packing articles such as eggs in the pockets of a carton or tray comprising
- means to separate the eggs into rows,
- an inclined conveyor,
- means to feed the eggs in each row one at a time to said inclined conveyor located adjacent the lower end of said inclined conveyor,
- means on said conveyor for moving the eggs in the direction of their pointed ends,
- means to turn the eggs to a point down position located near the top end of said inclined conveyor,
- and means to supportingly carry and maintain the eggs in the point down position from near the top end of said inclined conveyor to the pockets therebelow.

9. The apparatus of claim 8, further characterized by said inclined conveyor including
- means to move the eggs in the direction of their pointed ends while also moving them up said inclined conveyor.

10. The apparatus of claim 9, further characterized by
- said means to move the eggs in the direction of their pointed ends including
  - at least one positively driven rotating bar supporting the egg.

11. The apparatus of claim 8, further characterized by
- said means to turn the eggs to a point down position including
  - a downward depending member located in the path of each row of eggs and centered between the limits of travel of the eggs moving in the direction of their pointed ends.

12. The apparatus of claim 11, further characterized by
- said downward depending member having a substantially V-shape with the closed end of the V pointing toward the approaching eggs.

13. The apparatus of claim 12, further characterized by
- said downward depending member being spring mounted for freedom of movement.

14. The apparatus of claim 8, further characterized by means to temporarily arrest the downward movement of the eggs.

15. The apparatus of claim 14, further characterized by said means to temporarily arrest the downward movement of the eggs including a half shell-shaped retainer, and a complementary half shell-shaped swinging member whereby the egg is temporarily retained between said half shell retainer and said half shell member.

16. The apparatus of claim 15, further characterized by said half shell-shaped swinging member being cam operated relative to the movement of said inclined conveyor.

17. The apparatus of claim 8, further characterized by said means to carry the eggs from said inclined conveyor to the pockets including means to move the eggs horizontally during their descent to move them in register with the pockets.

18. The apparatus of claim 8, further characterized by said means to carry the eggs from said inclined conveyor to the pockets including a plurality of pairs of pivotable clam-shells mounted in a row for horizontal movement relative to each other while moving vertically as a unit, and means to separate said clam-shells near the bottom of their vertical movement to release the eggs held therebetween.

19. The apparatus of claim 18, further characterized by at least one cable connected vertically relative to said carrying means, a disk having said cable wound around its periphery to allow travel of said disk up and down said cable, crank handle means connected to said disk at an eccentric point on said disk, the opposite end of said crank handle means connected to one of said pairs of clam-shells, said one pair of clam-shells connected to an adjacent pair of clam-shells through lost motion linkage, and the next adjacent pair of clam-shells connected to said adjacent pair of clam-shells through lost motion linkage.

20. The apparatus of claim 18, further characterized by a vertical cable connected relative to each side of said carrying means, a disk connected to each of said cables with said cable wound around the periphery of said connected disk, a crank handle means connected to each said disk at an eccentric point on said disk, the opposite end of each of said crank handle means connected to a pair of said clam-shells on the end of said carrying means closest to said disk, the remaining pairs of said clam-shells connected to either of said pairs of clam-shells connected to said crank handle means whereby the center-to-center spacing of eggs supported by said clam-shells is changed during their downward movement toward the pockets.

21. The apparatus of claim 20, further characterized by said clam-shells on the same side of each pair connected to each other by lost motion linkage.

22. A method of packing articles such as eggs in the pockets of a carton or tray comprising the steps of separating the eggs into rows, feeding the eggs in each row one at a time to a conveyor, moving the eggs in the direction of their pointed ends while also moving them along the conveyor, turning the eggs to a point down position near the exit end of the conveyor, and supportingly carrying the eggs after they assume and while maintained in the point down position from the conveyor to the pockets vertically therebelow.

23. The method of claim 22, further characterized by turning the eggs to a point down position by moving them past and contacting them with a member centered between the limits of travel of the eggs moving in the direction of their pointed ends.

24. The method of claim 22, further characterized by temporarily arresting the downward movement of the eggs before carrying the eggs to the pockets from the exit end of the conveyor.

25. The method of claim 24, further characterized by moving the eggs from separate rows in a horizontal direction to change their center-to-center spacing while carrying them down to the pockets.

26. The method of claim 22, further characterized by moving the eggs from separate rows in a horizontal direction to change their center-to-center spacing while carrying them down to the pockets.

27. The method of claim 26, further characterized by changing the center-to-center spacing to make it smaller thus moving the eggs closer together to place them into the pockets.

28. Apparatus for packing articles such as eggs in the pockets of a carton or tray comprising means to separate the eggs into rows, a conveyor, means to feed the eggs in each row one at a time to said conveyor located adjacent the entrance end of said conveyor, means on said conveyor for moving the eggs in the direction of their pointed ends, means to turn the eggs to a point down position located near the exit end of said conveyor, and means to supportingly carry and maintain the eggs in the point down position from near the exit end of said conveyor to the pockets therebelow.

29. The apparatus of claim 28, further characterized by said means to turn the eggs to a point down position including a downward depending member located in the path of each row of eggs and centered between the limits of travel of the eggs moving in the direction of their pointed ends.

30. The apparatus of claim 29, further characterized by said downward depending member having a substantially V-shape with the closed end of the V pointing toward the approaching eggs.

31. The apparatus of claim 30, further characterized by said downward depending member being spring mounted for freedom of movement.

32. The apparatus of claim 28, further characterized by means to temporarily arrest the downward movement of the eggs.

33. The apparatus of claim 32, further characterized by said means to temporarily arrest the downward movement of the eggs including a half shell-shaped retainer, and a complementary half shell-shaped swinging member whereby the egg is temporarily retained between said half shell retainer and said half shell member.

34. The apparatus of claim 33, further characterized by said half shell-shaped swinging member being cam operated relative to the movement of said conveyor.

35. The apparatus of claim 28, further characterized by said means to carry the eggs from said conveyor to the pockets including means to move the eggs horizontally during their descent to move them in register with the pockets.

36. The apparatus of claim 28, further characterized by said means to carry the eggs from said conveyor to the pockets including a plurality of pairs of pivotable clam-shells mounted in a row for horizontal movement relative to each other while moving vertically as a unit, and means to separate said clam-shells near the bottom of their vertical movement to release the eggs held therebetween.

37. The apparatus of claim 36, further characterized by at least one cable connected vertically relative to said carrying means, a disk having said cable wound around its periphery to allow travel of said disk up and down said cable, crank handle means connected to said disk at an eccentric point on said disk, the opposite end of said crank handle means connected to one of said pairs of clam-shells, said one pair of clam-shells connected to an adjacent pair of clam-shells through lost motion linkage, and the next adjacent pair of clam-shells connected to said adjacent pair of clam-shells through lost motion linkage.

38. The apparatus of claim 36, further characterized by a vertical cable connected relative to each side of said carrying means, a disk connected to each of said cables with said cable wound around the periphery of said connected disk, a crank handle means connected to each said disk at an eccentric point on said disk, the opposite end of each of said crank handle means connected to a pair of said clam-shells on the end of said transport means closest to said disk, the remaining pairs of said clam-shells connected to either of said pairs of clam-shells connected to said crank handle means whereby the center-to-center spacing of eggs supported by said clam-shells is changed during their downward movement toward the pockets.

39. The apparatus of claim 38, further characterized by said clam-shells on the same side of each pair connected to each other by lost motion linkage.

* * * * *